US010859059B2

(12) United States Patent
Nakamura

(10) Patent No.: US 10,859,059 B2
(45) Date of Patent: Dec. 8, 2020

(54) DISCHARGE STATE DETECTING APPARATUS OF INTERNAL COMBUSTION ENGINE

(71) Applicant: Mitsubishi Electric Corporation, Tokyo (JP)

(72) Inventor: Toshifumi Nakamura, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 16/752,931

(22) Filed: Jan. 27, 2020

(65) Prior Publication Data

US 2020/0318599 A1 Oct. 8, 2020

(30) Foreign Application Priority Data

Apr. 2, 2019 (JP) ..... 2019-070367

(51) Int. Cl.
*F02P 1/00* (2006.01)
*F02P 17/12* (2006.01)
(Continued)

(52) U.S. Cl.
CPC ..... *F02P 17/12* (2013.01); *F02P 15/10* (2013.01); *F02P 3/053* (2013.01); *F02P 9/007* (2013.01);
(Continued)

(58) Field of Classification Search
CPC ..... F02P 17/12; F02P 3/045; F02P 3/0453; F02P 3/0456; F02P 9/002; F02P 3/0552;
(Continued)

(56) References Cited

U.S. PATENT DOCUMENTS 3,728,628 A * 4/1973 Saita ..... G01P 3/4807 324/169
2002/0033041 A1* 3/2002 Yamada ..... F02P 17/12 73/35.01
(Continued)

FOREIGN PATENT DOCUMENTS

JP 2001-295743 A 10/2001
JP 2012-207669 A 10/2012
(Continued)

*Primary Examiner* — John Kwon
(74) *Attorney, Agent, or Firm* — Sughrue Mion, PLLC; Richard C. Turner

(57) ABSTRACT

Even when detecting the primary voltage of the primary coil side, without detecting the secondary voltage of the secondary coil side of high voltage, it is desired to provide a discharge state detecting apparatus of an internal combustion engine which can detect a spark discharge state with good accuracy, by reducing influences of the discharge current and the resistance component of the discharge path of the secondary coil side, which are generated in the primary voltage. A discharge state detecting apparatus of an internal combustion engine performs correction which reduces a signal component generated by the secondary current in the ignition coil from the primary voltage detected by the primary voltage detector, based on the detected secondary current, and outputs a primary voltage after correction; and determines a spark discharge state based on the primary voltage after correction.

18 Claims, 6 Drawing Sheets

(51) Int. Cl.

| | |
|---|---|
| ***F02P 15/10*** | (2006.01) |
| *F02P 15/08* | (2006.01) |
| *F02P 3/05* | (2006.01) |
| *F02P 9/00* | (2006.01) |

(52) U.S. Cl.
CPC ..... *F02P 15/08* (2013.01); *F02P 2017/121* (2013.01)

(58) Field of Classification Search
CPC .. F02P 3/0554; F02P 2017/006; F02P 17/121; F02P 3/051; F02P 3/053; F02P 17/00; F02P 17/10; F02P 11/06; F02P 11/02
USPC ..... 123/594, 609, 621, 644
See application file for complete search history.

(56) References Cited

U.S. PATENT DOCUMENTS

| | | | | |
|---|---|---|---|---|
| 2013/0199485 | A1 | 8/2013 | Shibata et al. | |
| 2016/0061177 | A1* | 3/2016 | Ishitani | F02P 3/0435 123/623 |
| 2016/0084214 | A1 | 3/2016 | Okuda | |
| 2017/0331262 | A1* | 11/2017 | Tanaya | H01T 19/00 |
| 2018/0066597 | A1* | 3/2018 | Fukuzumi | F02D 41/20 |
| 2018/0119666 | A1* | 5/2018 | Nakamura | F02P 3/053 |
| 2018/0266381 | A1* | 9/2018 | Kosuge | F02P 9/007 |

FOREIGN PATENT DOCUMENTS

| | | | |
|---|---|---|---|
| JP | 2013-177881 | A | 9/2013 |
| JP | 2016-065462 | A | 4/2016 |

* cited by examiner

DISCHARGE STATE DETECTING APPARATUS OF INTERNAL COMBUSTION ENGINE

INCORPORATION BY REFERENCE

The disclosure of Japanese Patent Application No. 2019-70367 filed on Apr. 2, 2019 including its specification, claims and drawings, is incorporated herein by reference in its entirety.

BACKGROUND

The present disclosure is related with a discharge state detecting apparatus of an internal combustion engine.

In the spark discharge generated between the discharge electrodes of the spark plug, the spark discharge path extends in the circular arc shape, by flowing the discharge by in-cylinder flow. It is already known that by detecting this discharge extension of the spark discharge path and processing appropriately, information on a gas flow speed inside the combustion chamber and a combustion state, and information on an ignition plug state, such as plug smoldering, can be obtained. Then, by estimating an in-cylinder state of the internal combustion engine based on the discharge state information, such as the discharge extension of the spark discharge path and the plug state, and correcting the ignition timing, the fuel injection amount, and the like, the combustion state of the internal combustion engine can be maintained optimally.

It is already known that the discharge state information, such as the discharge extension of the spark discharge path and the plug state, correlates with the spark discharge voltage between the electrodes of the ignition plug. The method of obtaining this spark discharge voltage between the electrodes of the ignition plug which is the most direct and has few errors is performing directly probing of a voltage generated in the high-voltage side of the secondary coil (hereinafter, referred to a secondary voltage) by a voltage detecting element.

Actually, as disclosed in JP 2013-177881 A, the secondary voltage is measured directly by arranging a Zener diode and a current sensing resistor to the high-voltage side of the secondary coil. However, since it is difficult to obtain a small voltage detecting element which can withstand the high voltage of tens of kV at the dielectric breakdown and maintain the reliability of device, it is not actually easy to measure the secondary voltage directly. When short destruction of the voltage detecting element occurs, the generated current of the secondary coil leaks and it leads to loss of the ignition function of the ignition device itself. Accordingly, the reliability of the ignition device itself is degraded.

For that reason, the method of measuring the secondary voltage indirectly by using a voltage generated in the primary coil side (hereinafter, referred to a primary voltage) whose voltage generated at the spark discharge of the ignition device is comparatively low (about from 10V to hundreds of V) is already proposed. For example, as disclosed in JP 2016-65462 A and JP 2012-207669 A, the plug abnormal condition and the spark discharge state are detected by setting a threshold value to the primary voltage. And, as disclosed in JP 2001-295743 A, the maintaining period of the spark discharge is measured from a period when the primary voltage is generated, and the gap length of the electrode of the ignition plug is estimated.

SUMMARY

As a result of study by inventor, when measuring the secondary voltage indirectly using the primary voltage information as mentioned above, an influence of a secondary current of the secondary coil side caused by a resistance component of the discharge path of the secondary current and the secondary current which flows into the secondary coil is superimposed on the primary voltage, and its influence cannot be ignored.

In detail, a voltage obtained by dividing a voltage which multiplied the resistance component of the discharge path of the secondary current and the secondary current to a terminal voltage of the high voltage side of the secondary coil, by a winding number of the primary coil and the secondary coil is superimposed on the primary voltage generated in the primary coil. For example, the resistance component of the discharge path of the secondary current is a total value of a winding resistor of the secondary coil, a wiring resistance of the discharge path, and a resistance in the ignition plug. Therefore, in the spark discharge period when the secondary current is generated, a voltage ratio between the primary voltage and the secondary voltage is varied by the secondary current value at each time, and does not become the winding number ratio between the primary coil and the secondary coil simply. Accordingly, only by measuring the primary voltage information, accurate information on the spark discharge state cannot be obtained.

When detecting the breakdown voltage (tens of kV) between the discharge electrodes of the ignition plug, since an influence ratio of the secondary current in the primary voltage is 1/tens of the generated primary voltage and small, the influence can be ignored. However, when detecting the spark discharge voltage between the discharge electrodes of the ignition plug which is hundreds to several kV, the influence ratio of the secondary current in the primary voltage becomes large, and the influence cannot be ignored. Therefore, when the spark discharge state and the plug abnormal condition are detected by setting the threshold value to the detected primary voltage simply as JP 2016-65462 A and JP 2012-207669 A, error or erroneous determination may cause in discharge state determination due to the above influence of the secondary current. In order to prevent erroneous determination of the discharge state determination in this method, since the threshold value must be set to a sufficiently high value which is not influenced by the secondary current, detection accuracy of the spark discharge state cannot be improved. Although there is an example which avoids this problem by using only the information on the primary voltage generating interval which is not influenced by the secondary current as JP 2001-295743 A, a real time detection of the discharge state in the ignition cycle is difficult.

In view of the foregoing background, even when detecting the primary voltage of the primary coil side, without detecting the secondary voltage of the secondary coil side of high voltage, it is desired to provide a discharge state detecting apparatus of an internal combustion engine which can detect a spark discharge state with good accuracy, by reducing influences of the discharge current and the resistance component of the discharge path of the secondary coil side, which are generated in the primary voltage.

A discharge state detecting apparatus of an internal combustion engine according to the present disclosure including:

an ignition plug that has a first electrode and a second electrode which oppose via a gap, and ignites a combustible gas mixture in a combustion chamber;

an ignition coil that has a primary coil in which power is supplied from a DC power source, and a secondary coil which is magnetically coupled with the primary coil and supplies power to the ignition plug;

a driver circuit that turns on or turns off an energization to the primary coil from the DC power source;

a primary voltage detection unit that detects a primary voltage generated on the primary coil side during spark discharge of the ignition plug;

a secondary current detection unit that detects a secondary current which flows into the secondary coil during the spark discharge of the ignition plug;

a primary voltage correction unit that performs correction which reduces a signal component generated by the secondary current in the ignition coil, from the primary voltage detected by the primary voltage detection unit, based on the secondary current detected by the secondary current detection unit, and outputs a primary voltage after correction; and a discharge state determination unit that determines a spark discharge state based on the primary voltage after correction.

According to the discharge state detecting apparatus of the internal combustion engine concerning the present disclosure, variation of the primary voltage by the secondary current can be detected by detecting the secondary current. Then, the signal component generated by the secondary current can be reduced from the detected primary voltage based on the detected secondary current, and the information on the secondary voltage can be detected with good accuracy by the primary voltage. Therefore, without measuring the secondary voltage of high voltage directly, the spark discharge state can be determined with good accuracy, based on the primary voltage after correction.

DETAILED DESCRIPTION OF THE EMBODIMENTS

Hereinafter, embodiment of a discharge state detecting apparatus of an internal combustion engine according to present disclosure will be explained in detail with reference to drawings.

1. Embodiment 1

Figure 1:
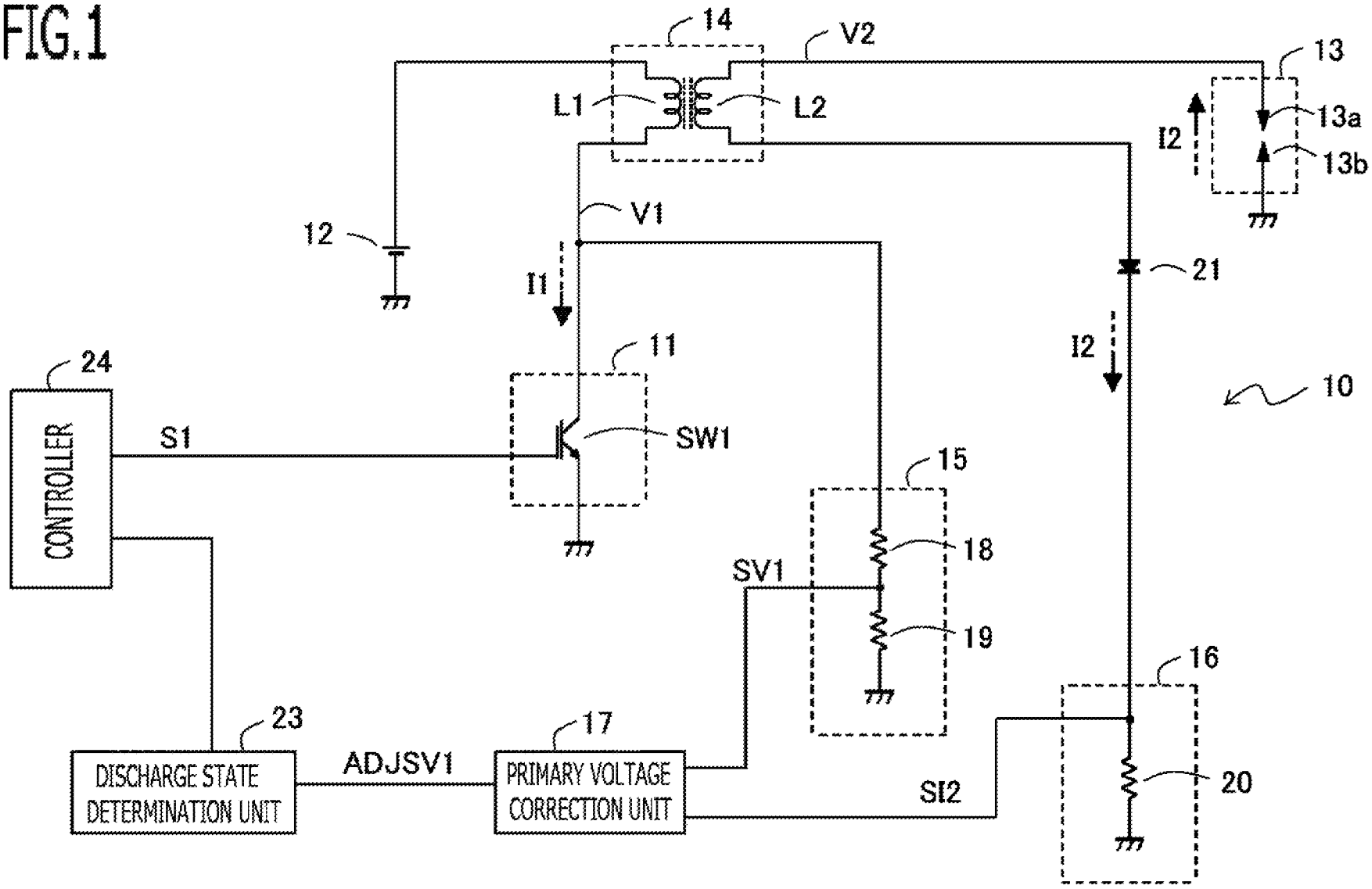
FIG. 1 is a schematic configuration diagram of the discharge state detecting apparatus of the internal combustion engine according to Embodiment 1.

FIG. 1 is an electric diagram showing the basic configuration of the discharge state detecting apparatus 10 of the internal combustion engine (hereinafter, referred to the discharge state detecting apparatus 10) according to Embodiment 1. In the present embodiment, as an example of a discharge state detection, a spark discharge extension is detected.

As shown in the circuit diagram of FIG. 1, the discharge state detecting apparatus 10 is provided with an ignition plug 13, an ignition coil 14, a driver circuit 11, a primary voltage detection unit 15, a secondary current detection unit 16, a primary voltage correction unit 17, a discharge state determination unit 23, a controller 24, and the like.

Although the internal combustion engine of a single cylinder will be explained, it is applicable also to the internal combustion engine having multiple cylinders. In that case, corresponding to each of the multiple cylinders, a plurality of the ignition plugs 13, the ignition coils 14, the driver circuits 11, the primary voltage detection units 15, the secondary current detection units 16, the primary voltage correction units 17, and the discharge state determination units 23 are provided. But, the one controller 24 is shared among multiple cylinders.

1-1. Basic Configuration of Ignition Device

The ignition plug 13 has a first electrode 13*a* and a second electrode 13*b* which oppose via a gap, and ignites a combustible gas mixture in a combustion chamber. The first electrode 13*a* and the second electrode 13*b* of the ignition plug 13 are arranged in the combustion chamber (inside the cylinder). The first electrode 13*a* is connected to a secondary coil L2, and the second electrode 13*b* is connected to a ground.

The ignition coil 14 is provided with a primary coil L1 in which power is supplied from a DC power source 12, and a secondary coil L2 which is magnetically coupled with the primary coil L1, and supplies power to the ignition plug 13. A winding number N2 of the secondary coil L2 is larger than a winding number N1 of the primary coil L1, and it is set to a predetermined winding number ratio RN12. The primary coil L1 and the secondary coil L2 are wound around a common iron core, and become a step-up transformer.

A high-voltage side terminal of the secondary coil L2 is connected to the first electrode 13*a* of the ignition plug 13, and a low-voltage side terminal of the secondary coil L2 is connected to the ground side via a backflow prevention diode 21. An anode of the backflow prevention diode 21 is connected to the secondary coil L2 side, and a cathode is connected to the ground side. The backflow prevention diode 21 passes a current flowing from the secondary coil L2 to the ground. A secondary current I2 which flowed into the secondary coil L2 from the spark plug 13 during the spark discharge of the spark plug 13 flows into the ground side via the backflow prevention diode 21 from the secondary coil L2.

The high-voltage side terminal of the primary coil L1 is connected to a positive electrode terminal of the DC power source 12. The negative electrode terminal of the DC power source 12 is connected to the ground. The DC power source 12 outputs a power source voltage. A lead battery and the like is used for DC power source 12. The DC power source 12 outputs a rated power source voltage such as 12V.

The low-voltage side terminal of the primary coil L1 is connected to the ground via the driver circuit 11. In the present embodiment, the driver circuit 11 is configured by a switching device SW1. For example, IGBT (Insulated Gate Bipolar Transistor) or a transistor is used for the switching device SW1. When the switching device SW1 is turned on by a command signal S1 of the controller 24, power is supplied to the primary coil L1 from the DC power source 12. When the switching device SW1 is turned off by the command signal S1 of the controller 24, the electric power supply from the DC power source 12 to the primary coil L1 stops.

In order to make the secondary coil L2 generate a high voltage and to make the electrode of the ignition plug 13 generate spark discharge, the controller 24 turns off after turning on the driver circuit 11. The controller 24 calculates an energizing period to the primary coil L1, and an ignition timing (ignition crank angle). The controller 24 turns on the driver circuit 11 during the energizing period and energizes the primary coil L1. After that, the controller 24 turns off the driver circuit 11 at the ignition timing, shuts off the energization to the primary coil L1, and causes the spark discharge. The spark discharge continues until the magnetic energy accumulated in the iron core of the spark plug 13 decreases.

Figure 6:
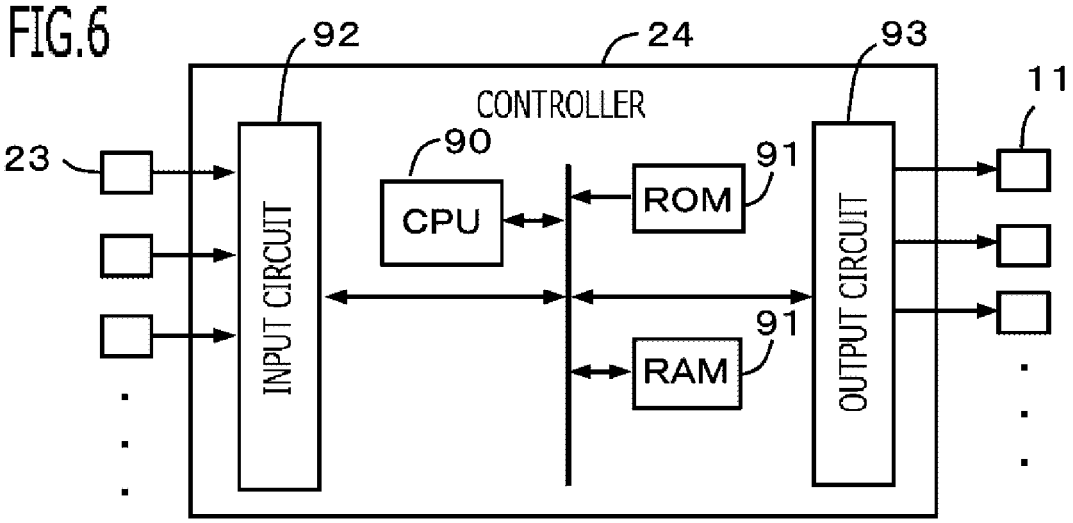
FIG. 6 is a hardware configuration diagram of the controller according to Embodiment 1.

In the present embodiment, the controller 24 is an internal combustion engine controller which controls an internal combustion engine. As shown in FIG. 6, the controller 24 is provided with, as a processing circuit, an arithmetic processor (computer) 90 such as a CPU (Central Processing Unit), storage apparatuses 91 that exchange data with the arithmetic processor 90, an input circuit 92 that inputs external signals to the arithmetic processor 90, an output circuit 93 that outputs signals from the arithmetic processor 90 to the outside, and the like.

As the arithmetic processor 90, ASIC (Application Specific Integrated Circuit), IC (Integrated Circuit), DSP (Digital Signal Processor), FPGA (Field Programmable Gate Array), various kinds of logical circuits, various kinds of signal processing circuits, and the like may be provided. As the arithmetic processor 90, a plurality of the same type ones or the different type ones may be provided, and each processing may be shared and executed. As the storage apparatuses 91, there are provided a RAM (Random Access Memory) which can read data and write data from the arithmetic processor 90, a ROM (Read Only Memory) which can read data from the arithmetic processor 90, and the like. The input circuit 92 is connected with various kinds of sensors and switches such as the discharge state determination unit 23, a crank angle sensor, a cam angle sensor, an intake air amount detection sensor, a water temperature sensor, and a power source voltage sensor, and is provided with an A/D converter and the like for inputting output signals from the sensors and the switches to the arithmetic processor 90. The output circuit 93 is connected with electric loads such as the driver circuit 11, an injector, and an actuator of a flow operation mechanism, and is provided with a driving circuit and the like for outputting a control signal from the calculation processor 90.

Then, the arithmetic processor 90 runs software items (programs) stored in the storage apparatus 91 such as a ROM and collaborates with other hardware devices in the controller 24, such as the storage apparatus 91, the input circuit 92, and the output circuit 93, so that the respective functions provided in the controller 24 are realized.

As basic control, the controller 24 calculates a fuel injection amount, an ignition timing, and the like, based on inputted output signals and the like from the various kinds of sensors, and then performs driving control of the injector, the driver circuit 11, and the like. The controller 24 performs driving control of the flow operation mechanism.

1-2. Detection of Discharge State by Primary Voltage and Primary Current 1-2-1. Detection Principle of Discharge State As mentioned above, the discharge spark of the ignition plug 13 is extended by gas flow inside the combustion chamber. Discharge extension becomes large when the gas flow is large. Discharge extension becomes small when a gas flow is small. There is correlation between the discharge extension and the discharge voltage between the electrodes of the ignition plug 13. The discharge voltage between the electrodes of the ignition plug 13 appears in the voltage on the ignition plug 13 side of the secondary coil L2 (hereinafter, referred to a secondary voltage V2). Therefore, although the secondary voltage V2 can be detected directly, it is not easy to prepare a reliable and low cost voltage detection element which can detect the high voltage of several tens of kV at the dielectric breakdown. Therefore, in the present disclosure, using the voltage generated in the primary coil L1 (hereinafter, referred to a primary voltage V1) whose voltage generated at the spark discharge is comparatively low, the information on the secondary voltage V2 is detected indirectly.

However, a voltage drop ΔV2 is generated by the secondary current I2 which flows during the spark discharge. The magnitude of the primary voltage V1 transmitted from the secondary coil L2 to the primary coil L1 increases by this voltage drop ΔV2 by the secondary current. A variation ΔV1 of the primary voltage by the voltage drop ΔV2 of the secondary voltage by the secondary current can be expressed by a next equation.

$$\Delta V2 = R2e \times I2 \tag{1}$$

$$RN12 = \frac{N2}{N1} = \frac{\Delta V2}{\Delta V1}$$

$$\Delta V1 = \frac{\Delta V2}{RN12} = \frac{R2e \times 12}{RN12}$$

As shown in the first equation of the equation (1), the voltage drop ΔV2 of the secondary voltage by secondary current becomes a value obtained by multiplying the secondary current I2 to a resistance value R2*e* of the discharge path of the secondary current (for example, a winding resistor value of the secondary coil L2, a wiring resistance value of the discharge path of the secondary current, and a resistance value in the ignition plug). As shown in the second equation of the equation (1), a ratio of the voltage drop ΔV2 of the secondary voltage to the variation ΔV1 of the primary voltage becomes a winding number ratio RN12 of the ignition coil 14. The winding number ratio RN12 is a ratio of a winding number N2 of the secondary coil L2 to a winding number N1 of the primary coil L1, and becomes larger than 1. Then, as shown in the third equation of the equation (1) obtained from the first equation and the second equation of the equation (1), the variation ΔV1 of the primary voltage by the secondary current becomes a value obtained by dividing a value multiplied the secondary current I2 to the resistance value R2*e* of the discharge path of the secondary current, by the winding number ratio RN12 of the ignition coil. Therefore, since the variation ΔV1 of the primary voltage by the secondary current becomes a value proportional to the secondary current I2, if the secondary current I2 is detectable, the variation ΔV1 of the primary voltage can be detected.

Then, as shown in a next equation, by subtracting the variation ΔV1 of the primary voltage by the secondary current I2 from the primary voltage V1 generated in the primary coil L1 during the spark discharge, the primary voltage V1_adj after correction in which the influence of the voltage drop by the secondary current I2 is reduced from the primary voltage V1 can be calculated. This primary voltage V1_adj after correction becomes a value proportional to the secondary voltage V2. When the primary voltage V1_adj after correction becomes large, it can be determine that the discharge extension is large.

$$V1_adj = V1 - \Delta V1 \tag{2}$$

1-2-2. Concrete Configuration Detecting Discharge State

Then, in the present embodiment, the discharge state detecting apparatus 10 is provided with a primary voltage detection unit 15, a secondary current detection unit 16, a primary voltage correction unit 17, and a discharge state determination unit 23.

<Primary Voltage Detection Unit 15>

The primary voltage detection unit 15 detects the primary voltage V1 generated on the primary coil L1 side during the spark discharge of the ignition plug 13. In the present embodiment, the primary voltage detection unit 15 is a resistive potential divider connected in parallel with the driver circuit 11, and outputs a divided voltage SV1 of the primary voltage V1. Since the driver circuit 11 (switching device) becomes off during the spark discharge and the primary coil L1 is connected to the ground via the primary voltage detection unit 15, the primary voltage V1 generated in the primary coil L1 can be detected by the primary voltage detection unit 15.

The primary voltage detection unit 15 is provided with a high-voltage side voltage dividing resistance 18 and a low-voltage side voltage dividing resistance 19 which were connected in series. A voltage SV1 of the connection point between the high-voltage side voltage dividing resistance 18 and the low-voltage side voltage dividing resistance 19 is outputted. A high-voltage side terminal of the high-voltage side voltage dividing resistance 18 is connected to the connection point (a low-voltage side terminal of the primary coil L1) between the primary coil L1 and the driver circuit 11. A low-voltage side terminal of the low-voltage side voltage dividing resistance 19 is connected to the ground. Therefore, as shown in a next equation, the output voltage SV1 of the primary voltage detection unit 15 becomes a voltage obtained by multiplying a voltage division ratio RR1 to the primary voltage V1 (a low-voltage side terminal voltage of the primary coil L1). Herein, the voltage division ratio RR1 is a ratio of a resistance value R19 of the low-voltage side voltage dividing resistance 19 to a total value of a resistance value R18 of the high-voltage side voltage dividing resistance 18, and the resistance value R19 of the low-voltage side voltage dividing resistance 19.

$$SV1 = RR1 \times V1 \tag{3}$$

$$RR1 = \frac{R19}{R18 + R19}$$

<Secondary Current Detection Unit 16>

The secondary current detection unit 16 detects the secondary current I2 which flows into the secondary coil L2 during the spark discharge of the ignition plug 13. In the present embodiment, the secondary current detection unit 16 is a resistance 20 connected in series on the discharge path of the secondary current I2 (hereinafter, referred to a secondary current detection resistance 20), and outputs a voltage SI2 of the high-voltage side terminal of the secondary current detection resistance 20.

In the present embodiment, the low-voltage side terminal of the secondary current detection resistance 20 is connected to the ground, and the high-voltage side terminal of the secondary current detection resistance 20 is connected to the cathode of the backflow prevention diode 21. Since a voltage drop occurs in the secondary current detection resistance 20 when the secondary current I2 flows, the drop voltage of the secondary current detection resistance 20 can be detected by the voltage SI2 of the high-voltage side terminal of the secondary current detection resistance 20. As shown in a next equation, the secondary current I2 becomes a value obtained by dividing the voltage SI2 of the high-voltage side terminal of the secondary current detection resistance 20 by a resistance value R20 of the secondary current detection resistance.

$$I2 = \frac{SI2}{R20} \tag{4}$$

<Primary Voltage Correction Unit 17>

The primary voltage correction unit 17 performs correction which reduces a signal component generated by the secondary current in the ignition coil 14, from the primary voltage detected by the primary voltage detection unit 15, based on the secondary current detected by the secondary current detection unit 16, and outputs a primary voltage after correction.

In the present embodiment, the primary voltage correction unit 17 performs correction which reduces the signal component generated by the secondary current in the ignition coil 14, from the output signal SV1 of the primary voltage detection unit 15, based on the output signal SI2 of the secondary current detection unit 16, and outputs a primary voltage signal ADJSV1 after correction.

According to this configuration, as mentioned above using the equation (1) and the equation (2), based on the output signal SI2 of the secondary current detection unit 16 which becomes a signal according to the secondary current I2, the variation ΔV1 of the primary voltage by the secondary current I2 can be detected. Then, based on the output signal SI2 of the secondary current detection unit 16, the signal component generated by the secondary current can be reduced from the output signal SV1 of the primary voltage detection unit 15 which becomes a signal according to the primary voltage V1 generated in the primary coil L1 during spark discharge.

<When the Primary Voltage Correction Circuit is Configured by a Differential Amplifying Circuit>

In the present embodiment, the primary voltage correction unit 17 is a differential amplifying circuit, and outputs, as the primary voltage signal ADJSV1 after correction, a voltage obtained by amplifying a difference voltage between the output signal SI2 of the secondary current detection unit 16 and the output signal SV1 of the primary voltage detection unit 15. Hereinafter, assuming that an amplification factor is 1, explanation is given.

In the present embodiment, the resistance values of each detection unit 15, 16 are adjusted so that the signal component generated by the secondary current can be reduced by obtaining a difference between two signals SV1, SI2. Hereinafter, setting of the resistance values is explained.

A next equation is obtained when the third equation of the equation (1), the first equation of the equation (3), and the equation (4) are substituted for the equation (2).

$$V1_\mathrm{adj} = \frac{1}{RR1} SV1 - \frac{R2e}{RN12 \times R20} SI2 \tag{5}$$

When the voltage division ratio RR1 of the primary voltage detection unit 15 is multiplied to the both sides of the equation (5), and a multiplication value of the voltage division ratio RR1 and the primary voltage V1_adj after correction is set to a primary voltage signal ADJSV1 after correction, a next equation is obtained.

$$ADJSV1 = RR1 \times V1_\text{adj} = SV1 - \frac{RR1 \times R2e}{RN12 \times R20} SI2 \tag{6}$$

As shown in the first equation of a next equation, if the coefficient of output signal SI2 in the most right side of the equation (6) becomes 1, the signal component generated by the secondary current can be reduced by obtaining the difference between two signals SV1, SI2. In order to do that, as shown in the second equation obtained by rearranging the first equation of a next equation with regard to the resistance value R20 of the secondary current detection resistance, the resistance value R20 of the secondary current detection resistance should be set. That is to say, the resistance value R20 of the secondary current detection resistance is set to a value obtained by dividing the total value of the voltage division ratio RR1 of the primary voltage detection unit and the resistance value R2*e* of the secondary current discharge path, by the winding number ratio RN12 of the ignition coil.

$$\frac{RR1 \times R2e}{RN12 \times R20} = 1 \tag{7}$$

$$R20 = \frac{RR1 \times R2e}{RN12}$$

For example, if the voltage division ratio RR1 of the primary voltage detection unit is 1/20, the resistance value R2*e* of the secondary current discharge path is 5 kΩ, and the winding number ratio RN12 of the ignition coil is 100, the resistance value R20 of the secondary current detection resistance becomes 2.50. Since the ignition energy loss becomes large when the resistance value R20 of the secondary current detection resistance is large, it is desirable to set the resistance value R20 less than or equal to 1000.

<Discharge State Determination Unit 23>

The discharge state determination unit 23 determines a spark discharge state based on the primary voltage signal ADJSV1 after correction. As mentioned above, when the primary voltage signal ADJSV1 after correction becomes a value proportional to the secondary voltage V2 and the primary voltage signal ADJSV1 after correction becomes large, it can be determined that the discharge extension is large.

In the present embodiment, when the primary voltage signal ADJSV1 after correction is larger than a primary voltage threshold value V1ref, the discharge state determination unit 23 determines that the discharge extension between the electrodes of the ignition plug 13 is large. When the primary voltage signal ADJSV1 after correction is smaller than the primary voltage threshold value V1ref, the discharge state determination unit 23 determines that the discharge extension between the electrodes of the ignition plug 13 is small.

The discharge state determination unit 23 is configured by a comparator circuit. The discharge state determination unit 23 compares a reference voltage as the primary voltage threshold value V1ref with the primary voltage signal ADJSV1 after correction; outputs the Hi level signal (for example, 5V) when the primary voltage signal ADJSV1 after correction exceeds the reference voltage; and outputs the Low level signal (for example, 0V) when the primary voltage signal ADJSV1 after correction is less than the reference voltage.

<Controller 24>

The controller 24 controls a combustion state, based on the determination result of the spark discharge state by the discharge state determination unit 23. For example, the controller 24 controls the flow operation mechanism which can operate the in-cylinder flow, based on the determination result of the spark discharge state.

The flow operation mechanism is a variable valve timing mechanism and the like which can change the opening and closing timing of one or both of the intake valve and the exhaust valve, for example. The flow operation mechanism may be any mechanism, as long as it is a mechanism which can operate the in-cylinder flow. For example, it may be an intake port valve and the like which produces a swirl flow or a tumble flow inside the cylinder.

When determining that the discharge extension is small in the ignition cycle of this time or the past and not determining that the discharge extension is large, the controller 24 operates the flow operation mechanism to the side of strengthening the in-cylinder flow. For example, the controller 24 changes the opening and closing phase angle of the intake and exhaust valve to the side of strengthening the in-cylinder flow. On the other hand, when the period determined that the discharge extension is large in the ignition cycle of this time or the past is longer than a threshold, the controller 24 operates the flow operation mechanism to the side of weakening the in-cylinder flow.

Alternatively, the controller 24 adjusts the fuel injection amount based on the determination result of the spark discharge state. For example, when determining that the discharge extension is small in the ignition cycle of this time or the past and not determining that the discharge extension is large, the controller 24 increases the fuel injection amount.

1-2-3. Control Behavior

Figure 2:
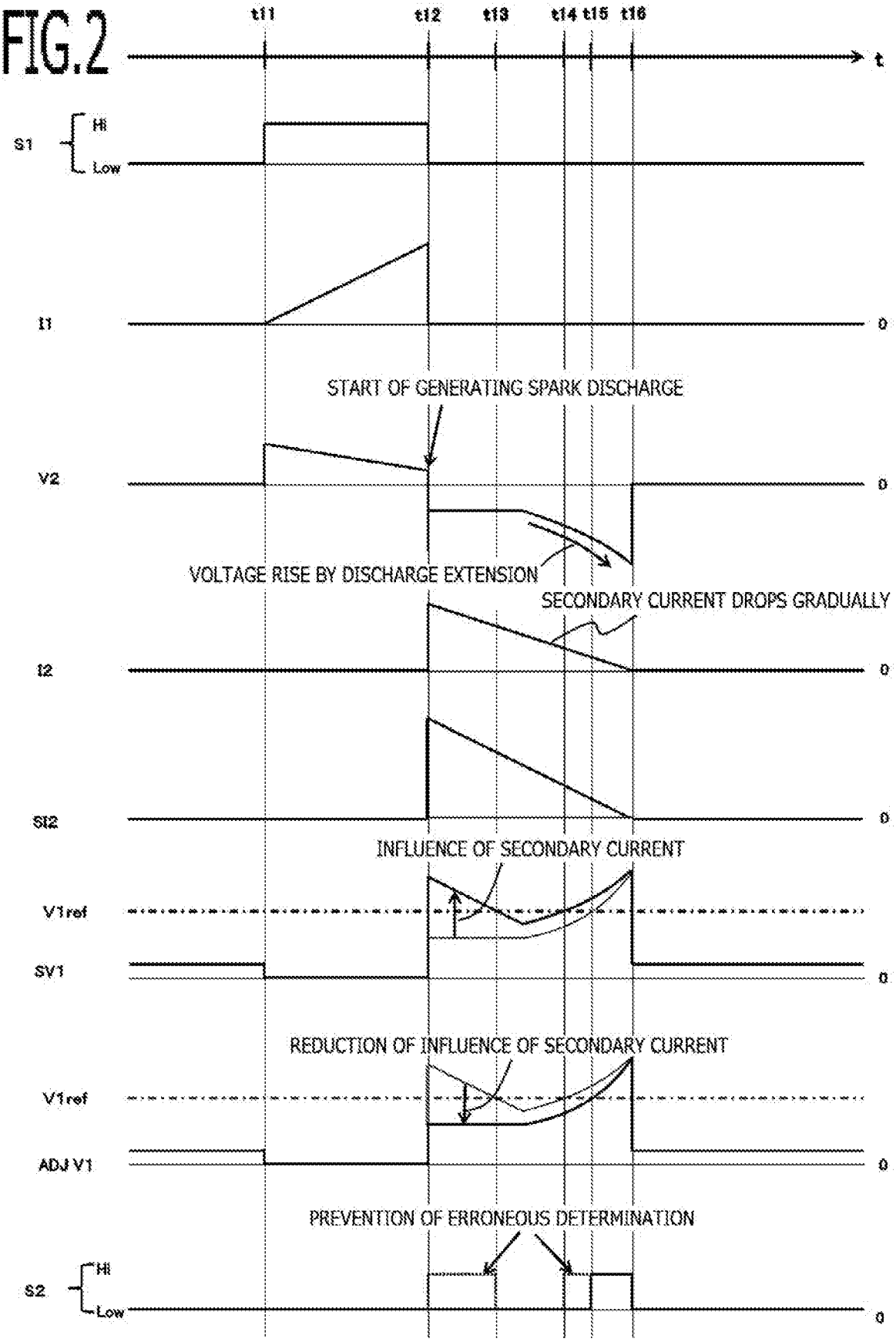
FIG. 2 is a time chart for explaining operation of the discharge state detecting apparatus of the internal combustion engine according to Embodiment 1.

Next, a control behavior is explained using the time chart shown in FIG. 2. At the time t11 of FIG. 2, the controller 24 switches the command signal S1 to the driver circuit 11 from the Low level to the Hi level, energizes the primary coil L1, and makes the primary current I1 flow. After that, at the time t12 when the energizing period elapsed, when the controller 24 switches the command signal S1 from the Hi level to the Low level and shuts down the energization of the primary coil L1, a negative high voltage for ignition is applied to the first electrode 13*a* of the ignition plug 13, its potential drops steeply, and the spark discharge is generated between the first electrode 13*a* and the second electrode 13*b* of the ignition plug 13.

At the time t12, when the spark discharge starts, after the secondary current I2 increases stepwise, the secondary current I2 decreases gradually as the magnetic energy accumulated in the iron core decreases. At the time t16, the secondary current I2 becomes zero and the spark discharge is finished. In proportion to this secondary current I2, the output voltage SI2 of the secondary current detection resistance 20 is changing.

During a period when the command signal S1 to the driver circuit 11 is the Low level and the driver circuit 11 is off, the divided voltage SV1 of the primary voltage can be detected by the primary voltage detection unit 15. During the spark discharge, the secondary voltage V2 in which positive and negative is reversed appears in the primary voltage V1. The voltage drop ΔV2 occurs in the discharge path by the secondary current I2. The primary voltage V1 transmitted from the secondary coil L2 to the primary coil L1 increases by this voltage drop ΔV2 by the secondary current. According to it, the divided voltage SV1 of the primary voltage also increases.

Therefore, unlike the present embodiment, if the discharge state is determined by comparing with the primary voltage threshold V1ref, using the divided voltage SV1 of the primary voltage as it is, from the time t12 to the time t13, due to the influence of the secondary current I2, the divided voltage SV1 of the primary voltage exceeds the primary voltage threshold value V1ref, and erroneous determination occurs.

The output voltage SI2 of the secondary current detection resistance 20 corresponds to the divided voltage of the variation ΔV1 of the primary voltage by the secondary current I2. Then, since the primary voltage signal ADJSV1 after correction is calculated by subtracting the output voltage SI2 of the secondary current detection resistance 20 from the divided voltage SV1 of the primary voltage, the influence of variation of the primary voltage by the secondary current I2 is reduced. Therefore, the primary voltage signal ADJSV1 after correction during the spark discharge from the time t12 to the time t16 is proportional to the positive and negative reversing value of the secondary voltage V2, and the discharge extension can be determined with good accuracy by the primary voltage signal ADJSV1.

Therefore, from the time t15 to the time t16, as the discharge extension increases, the magnitude of the secondary voltage V2 and the primary voltage signal ADJSV1 after correction increase. Then, when the primary voltage signal ADJSV1 after correction exceeds the primary voltage threshold value V1ref, the output signal S2 of the discharge state determination unit 23 becomes Hi level, and it is determined with good accuracy that the discharge extension is large.

At the time t16, the magnetic flux energy in the iron core is lost, and the spark discharge is finished. At the same time, the primary voltage signal ADJSV1 after correction is below the primary voltage threshold value V1ref, and the output signal S2 of the discharge state determination unit 23 switches from Hi level to the Low level.

2. Embodiment 2

Next, the discharge state detecting apparatus 10 according to Embodiment 2 will be explained. The explanation for constituent parts the same as those in Embodiment 1 will be omitted. The basic configuration and processing of the discharge state detecting apparatus 10 according to the present embodiment are the same as those of Embodiment 1. However, in the present embodiment, it is different from Embodiment 1 in that the controller 24 performs multi-ignition control based on the determination result of the spark discharge state by the discharge state determination unit 23.

The controller 24 increases the ignition frequency in one ignition cycle, based on the determination result of the spark discharge state by the discharge state determination unit 23. In the present embodiment, the controller 24 performs first ignition that turns off after turning on the driver circuit 11. Then, when the primary voltage signal ADJSV1 after correction does not become larger than the primary voltage threshold value V1ref, until a preliminarily set determination period elapses after turning off the driver circuit 11 in the first ignition, the controller 24 performs second ignition that turns off after turning on the driver circuit 11 again. And when the primary voltage signal ADJSV1 after correction becomes larger than the primary voltage threshold value V1ref, until the determination period elapses after turning off the driver circuit 11 in the first ignition, the controller 24 does not perform the second ignition.

According to this configuration, when the primary voltage signal ADJSV1 after correction during the determination period after the first ignition does not become larger than the primary voltage threshold value V1ref, it is estimated that the discharge extension is small and it is an ignition cycle with slow combustion, the second ignition is performed, and the combustion can be promoted by the increase in ignition energy. On the other hand, when the primary voltage signal ADJSV1 after correction during the determination period after the first ignition becomes larger than the primary voltage threshold value V1ref, it is estimated that the discharge extension is large and it is an ignition cycle with fast combustion, the second ignition is not performed, and the electrode consumption of the spark plug can be suppressed.

When the primary voltage signal ADJSV1 after correction does not become larger than the primary voltage threshold value V1ref, until a preliminarily set second determination period elapses after turning off the driver circuit 11 in the second ignition, the controller 24 may perform third ignition that turns off after turning on the driver circuit 11 again. And when the primary voltage signal ADJSV1 after correction becomes larger than the primary voltage threshold value V1ref, until the second determination period elapses after turning off the driver circuit 11 in the second ignition, the controller 24 may not perform the third ignition. Similarly, fourth or later ignition may be performed.

<Flowchart>

Figure 3:
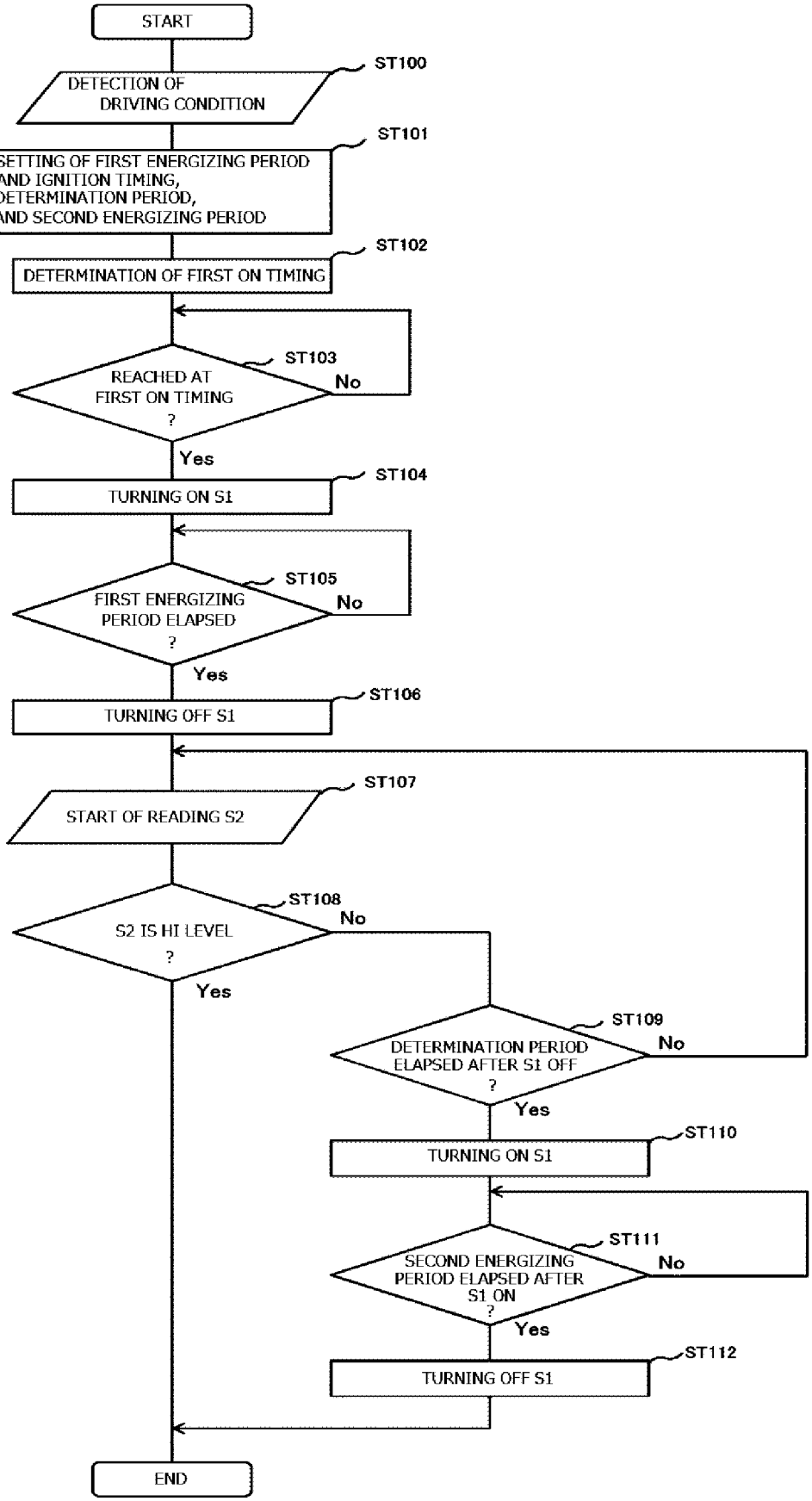
FIG. 3 is a flowchart for explaining processing of the multi-ignition control of the discharge state detecting apparatus of the internal combustion engine according to Embodiment 2.

Next, along with the flowchart shown in FIG. 3, processing of the multi-ignition control performed by the controller 24 will be explained. First, in the step ST100, the controller 24 reads the output signals of the crank angle sensor, the cam angle sensor, the intake air amount detection sensor, the water temperature sensor, and the like, and detects the driving condition of the internal combustion engine, such as the rotational speed, the charging efficiency, and the water temperature.

Then, in the step ST101, the controller 24 sets the first energizing period and the ignition timing, the determination period, the second energizing period, and the like, based on the detected driving condition.

Next, in the step ST102, the controller 24 determines the first ON timing of the driver circuit 11, based on the first energizing period and ignition timing, and the crank angle. Then, in the step ST103, the controller 24 determines whether it reached at the first ON timing. Then, when determining that it reached at the first ON timing (the step ST103: Yes), the controller 24 advances to the step ST104 and turns on the command signal S1 to the driver circuit 11 (switches from Low level to Hi level).

Then, in the step ST105, the controller 24 determines whether or not the first energizing period elapsed, after turning on the command signal S1 to the driver circuit 11. Then, when determining that the first energizing period elapsed (the step ST105: Yes), the controller 24 advances to the step ST106 and turns off the command signal S1 to the driver circuit 11 (switches from Hi level to Low level). The first spark discharge starts by off.

In the step ST107, the controller 24 starts reading of the output signal S2 of the discharge state determination unit 23. After that, the output signal S2 is read continuously. In the step ST108, the controller 24 determines whether or not the output signal S2 of the discharge state determination unit 23 is Hi level (whether or not the primary voltage signal ADJSV1 after correction is larger than the primary voltage threshold value V1ref).

When determining that the output signal S2 of the discharge state determination unit 23 is Hi level (the step ST108: Yes), the controller 24 determines that the combustion state is good and the second ignition is unnecessary since the discharge extension is large and the in-cylinder flow is large, and does not perform the second ignition and ends the processing of this time ignition cycle.

On the other hand, when determining that the output signal S2 of the discharge state determination unit 23 is not Hi level (the step ST108: No), the controller 24 advances to the step ST109 and determines whether or not the determination period elapsed, after turning off the command signal S1 in the first ignition in the step ST106. When determining that the determination period does not elapse (the step ST109: No), the controller 24 returns to the step ST107 and performs determination of the step ST108 again.

When determining that the determination period elapsed after turning off the command signal S1 while keeping the output signal S2 of the discharge state determination unit 23 Lo level (step ST109:

Yes), the controller 24 advances to the step ST110, turns on the command signal S1 to the driver circuit 11 (switches from Low level to Hi level), and starts the second ignition. Since the discharge extension is small and the in-cylinder flow is small, the second ignition is performed and the combustion is promoted. In the step ST111, the controller 24 determines whether or not the second energizing period elapsed, after turning on the command signal S1 to the driver circuit 11. Then, when determining that the second energizing period elapsed (the step ST111: Yes), the controller 24 advances to the step ST112 and turns off the command signal S1 to the driver circuit 11 (switches from Hi level to Low level). The second spark discharge starts by off. Then, processing of this time ignition cycle is ended.

<Control Behavior>

Figure 4:
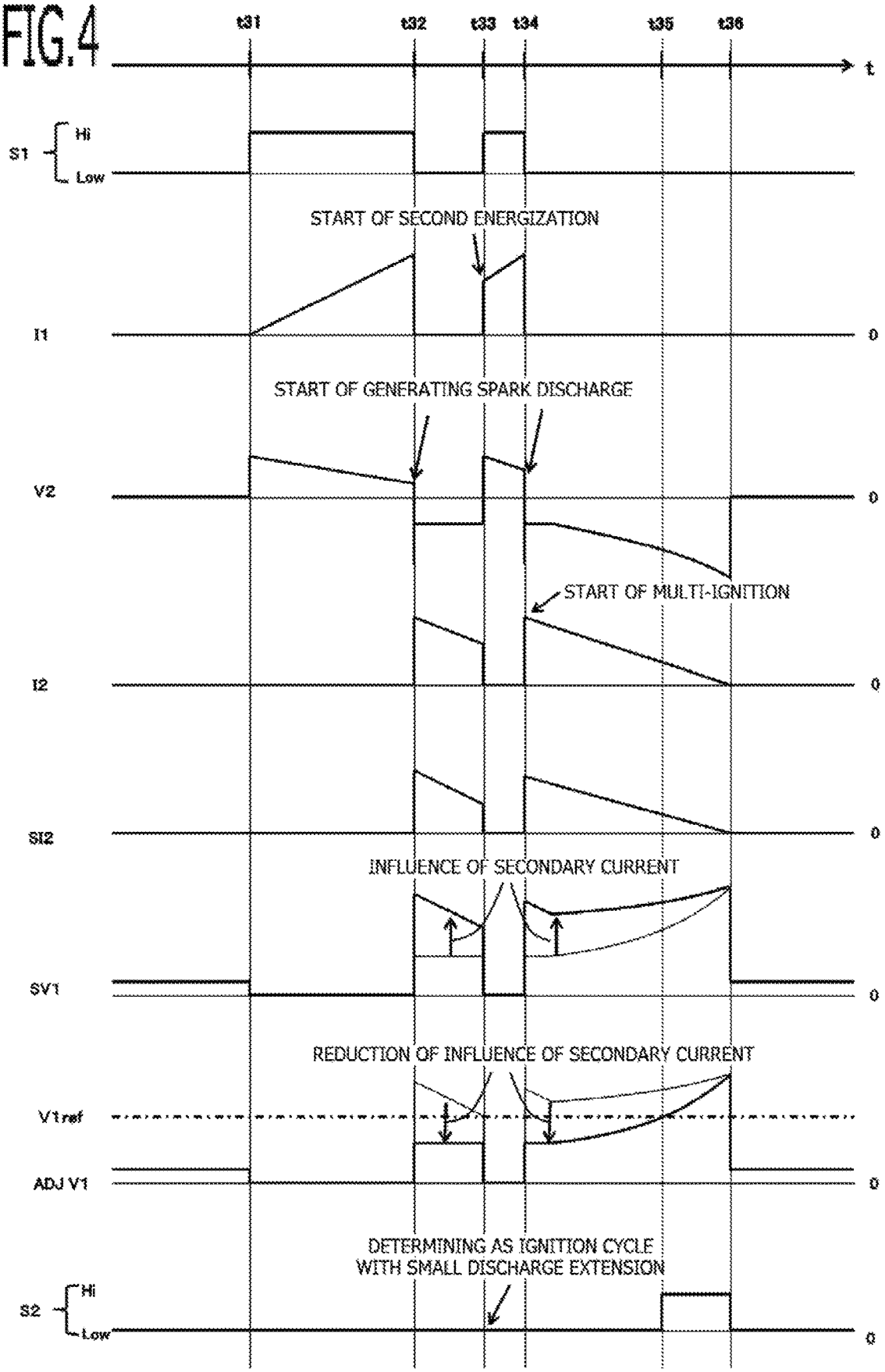
FIG. 4 is a time chart for explaining operation of the discharge state detecting apparatus of the internal combustion engine according to Embodiment 2.

Next, a control behavior is explained using the time chart shown in FIG. 4. At the time t31 of FIG. 4, the controller 24 switches the command signal S1 to the driver circuit 11 from the Low level to the Hi level, energizes the primary coil L1, and makes the primary current I1 flow. After that, at the time t32 when the energizing period elapsed, when the controller 24 switches the command signal S1 from the Hi level to the Low level and shuts down the energization of the primary coil L, the negative high voltage for ignition is applied to the first electrode 13*a* of the ignition plug 13, its potential drops steeply, and the spark discharge is generated between the first electrode 13*a* and the second electrode 13*b* of the ignition plug 13.

At the time t32, when the spark discharge starts, after the secondary current I2 increases stepwise, the secondary current I2 decreases gradually as the magnetic energy accumulated in the iron core decreases. In proportion to this secondary current I2, the output voltage SI2 of the secondary current detection resistance 20 is changing.

As explained in Embodiment 1, the voltage drop ΔV2 occurs in the discharge path by the secondary current I2. The primary voltage V1 transmitted from the secondary coil L2 to the primary coil L1 increases by this voltage drop ΔV2 by the secondary current. According to it, the divided voltage SV1 of the primary voltage also increases.

Then, since the primary voltage signal ADJSV1 after correction is calculated by subtracting the output voltage SI2 of the secondary current detection resistance 20 from the divided voltage SV1 of the primary voltage, the influence of variation of the primary voltage by the secondary current I2 is reduced. Therefore, primary voltage signal ADJSV1 after correction during the spark discharge from the time t32 to the time t33 is proportional to the positive and negative reversing value of the secondary voltage V2.

Therefore, in the determination period from the time t32 to the time t33, the primary voltage signal ADJSV1 after correction is less than the primary voltage threshold value V1ref, and it can be determined with good accuracy that the discharge extension is small. At the time t33, since the primary voltage signal ADJSV1 after correction did not become larger than the primary voltage threshold value V1ref until the determination period elapsed, the controller 24 determined to perform the second ignition. Since the discharge extension is small and the in-cylinder flow is small, the second ignition is performed and the combustion is promoted.

Then, at the time t33, the controller 24 switches the command signal S1 to the driver circuit 11 from the Low level to the Hi level, energizes the primary coil L1, and makes the primary current I1 flow. When the primary current I1 flows into the primary coil L1, the spark discharge stops and the magnetic flux energy is again stored in the iron core.

After that, at the time t34 when the second energizing period elapsed, when the controller 24 switches the command signal S1 from the Hi level to the Low level and shuts down the energization of the primary coil L1, the negative high voltage for ignition is applied to the first electrode 13*a* of the ignition plug 13, its potential drops steeply, and the second spark discharge is generated between the first electrode 13*a* and the second electrode 13*b* of the ignition plug 13.

Then, at the time t35, the primary voltage signal ADJSV1 after correction reaches the primary voltage threshold value V1ref, and the output signal S2 of the discharge state determination unit 23 switches from the Low level to the Hi level.

At the time t36, the magnetic flux energy in the iron core is lost, and the spark discharge is finished. At the same time, the primary voltage signal ADJSV1 after correction is below the primary voltage threshold value V1ref, and the output signal S2 of the discharge state determination unit 23 switches from Hi level to the Low level.

3. Embodiment 3

Next, the discharge state detecting apparatus 10 according to Embodiment 3 will be explained. The explanation for constituent parts the same as those in Embodiment 1 will be omitted. The basic configuration and processing of the discharge state detecting apparatus 10 according to the present embodiment are the same as those of Embodiment 1. However, in the present embodiment, it is different from Embodiment 1 in that the controller 24 determines the discharge abnormality of the ignition plug 13 based on the determination result of the spark discharge state by the discharge state determination unit 23.

In the internal combustion engine, an abnormal drop of the discharge voltage may be caused by an excessive electrode melting resulting from overheat of the ignition plug, an electrode short by an exudation phenomenon in the narrow gap plug electrode, a coil failure, and the like.

In the present embodiment, when the primary voltage signal ADJSV1 after correction is larger than a primary voltage threshold value V1ref2 for discharge abnormality determination, the discharge state determination unit 23 determines that the discharge of the ignition plug 13 is normal; and when the primary voltage signal ADJSV1 after correction is smaller than the primary voltage threshold value V1ref2 for discharge abnormality determination, the discharge state determination unit 23 determines that the discharge of the ignition plug 13 is abnormal. The primary voltage threshold value V1ref2 for discharge abnormality determination according to the present embodiment is set to a value smaller than the primary voltage threshold value V1ref of Embodiments 1 and 2 for determining large or small of the discharge extension.

When not determining that the primary voltage signal ADJSV1 after correction becomes larger than the primary voltage threshold value V1ref2 for discharge abnormality determination by the discharge state determination unit 23 in the one ignition cycle, the controller 24 determines that the discharge abnormality occurred in the ignition plug 13; and when determining that the primary voltage signal ADJSV1 after correction becomes larger than the primary voltage threshold value V1ref2 for discharge abnormality determination by the discharge state determination unit 23, the controller 24 determines that the discharge abnormality did not occur in the ignition plug 13.

Figure 5:
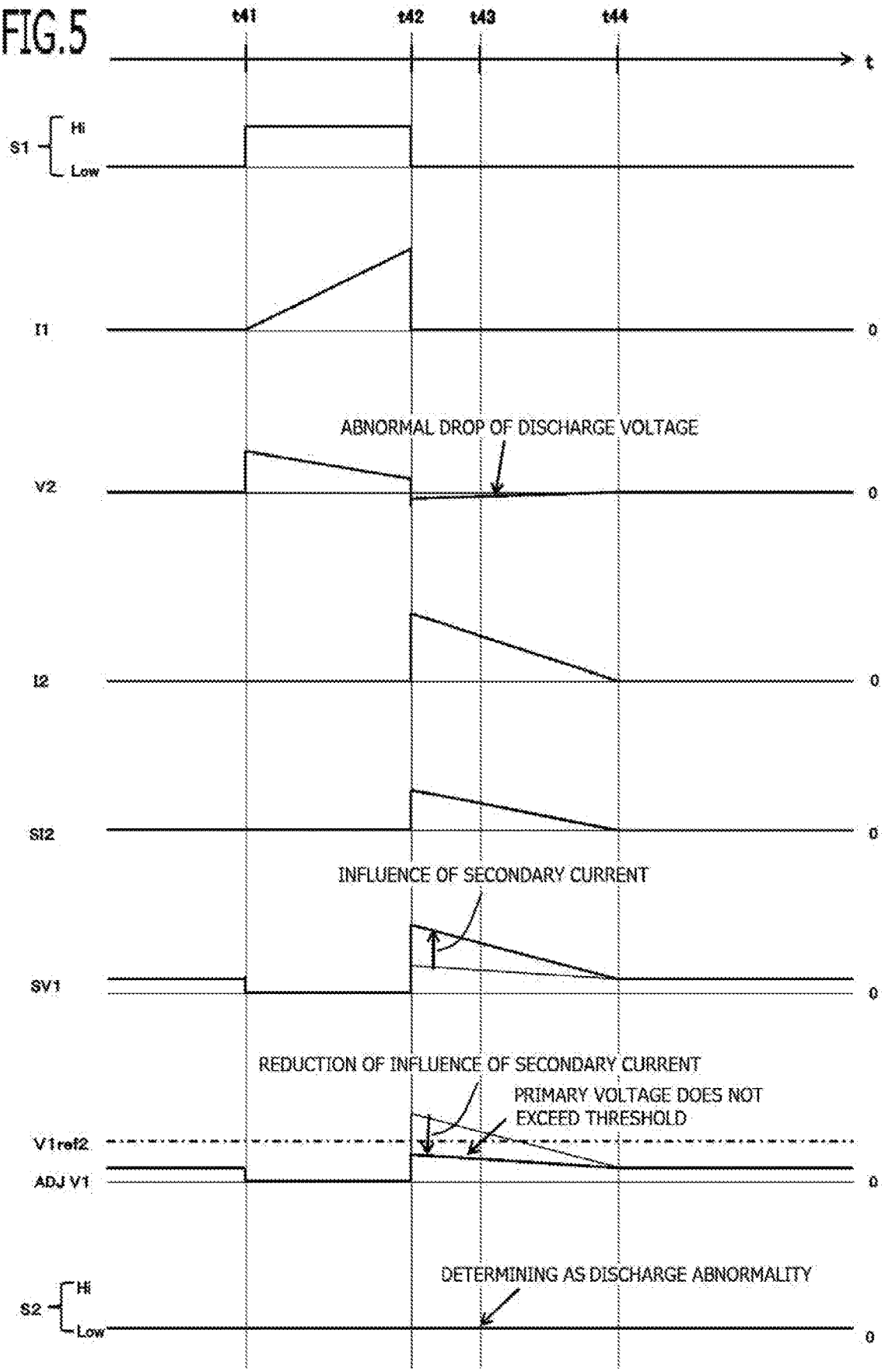
FIG. 5 is a time chart for explaining operation of the discharge state detecting apparatus of the internal combustion engine according to Embodiment 3.

Next, a control behavior is explained using the time chart shown in FIG. 5. At the time t41 of FIG. 5, the controller 24 switches the command signal S1 to the driver circuit 11 from the Low level to the Hi level, energizes the primary coil L1, and makes the primary current I1 flow. After that, at the time t42 when the energizing period elapsed, when the controller 24 switches the command signal S1 from the Hi level to the Low level and shuts down the energization of the primary coil L1, the negative high voltage for ignition is applied to the first electrode 13*a* of the ignition plug 13. However, when between the electrodes of the ignition plug 13 is short-circuited, the spark discharge is not formed between the electrodes. Therefore, the high voltage for ignition is consumed not between the spark plug electrodes but in the winding resistor of the secondary coil L2. Therefore, during a period from time t42 to time t44, the discharge voltage between the electrodes of the ignition plug 13 is not generated and the secondary voltage V2 is not generated so much. But, after the secondary current I2 increases stepwise, the secondary current I2 decreases gradually as the magnetic energy accumulated in the iron core decreases.

The influence of the secondary current I2 appears in the divided voltage SV1 of the primary voltage largely. But, the influence of the secondary current I2 is reduced in the primary voltage signal ADJSV1 after correction, and the primary voltage signal ADJSV1 after correction is a value according to the secondary voltage V2 which is not generated so much. Therefore, the primary voltage signal ADJSV1 after correction does not exceed the primary voltage threshold value V1ref2 for discharge abnormality determination.

The primary voltage signal ADJSV1 after correction does not exceed the primary voltage threshold value V1ref2 for discharge abnormality determination and the output signal S2 of the discharge state determination unit 23 does not becomes the Hi level, until a preliminarily set discharge determination period elapses after switching the command signal S to the driver circuit 11 to the Low level (from the time t42 to the time t43). Therefore, the controller 24 determines that the discharge abnormality occurred.

When determining that the discharge abnormality occurred, the controller 24 performs a control in case of abnormality, such as stopping the fuel injection. Accordingly, damage to the catalyst by unburnt gas can be prevented.

4. Embodiment 4

Next, the discharge state detecting apparatus 10 according to Embodiment 4 will be explained. The explanation for constituent parts the same as those in Embodiment 1 will be omitted. The basic configuration and processing of the discharge state detecting apparatus 10 according to the present embodiment are the same as those of Embodiment 1. However, in the present embodiment, it is different from Embodiment 1 in that the primary voltage correction unit 17 and the discharge state determination unit 23 are included in the controller 24, and accordingly more advanced correction processing is performed in the primary voltage correction unit 17.

In the present embodiment, the functions of the primary voltage correction unit 17 and the discharge state determination unit 23 are realized by processing of the arithmetic processor 90 of the controller 24 and the like. The output signal SV1 of the primary voltage detection unit 15 and the output signal SI2 of the secondary current detection unit 16 are inputted into the input circuit 92 of the controller 24.

<Variation Correction of Power Source Voltage>

The primary coil L1 is connected to the DC power source 12. The power source voltage Vdc is added to the primary voltage V1 during the discharge period in offset manner, in addition to a voltage transmitted from the secondary coil L2 side. Therefore, when the power source voltage is varied, the output signal SV1 of the primary voltage detection unit 15 is varied. In particular when the power source voltage Vdc is varied largely as at the time of cranking motor operation, variation of the output signal SV1 becomes large. For example, when the power source voltage Vdc drops by 6V and the voltage division ratio of the primary voltage detection unit 15 is 1/20, the output signal SV1 drops by 0.3V, and when the winding number ratio of the ignition coil is 100, it becomes a detection error of the secondary voltage V2 equivalent to 600V.

Then, the primary voltage correction unit 17 performs correction which reduces variation of the output signal SV1 of the primary voltage detection unit 15 by variation of the power source voltage Vdc, based on source voltage information of the DC power source 12. The output signal of the power source voltage sensor which detects the power source voltage Vdc of the DC power source 12 is inputted into the controller 24, and the power source voltage Vdc is detected.

In the present embodiment, as shown in a next equation, the primary voltage correction unit 17 calculates a fluctuation amount ΔVdc of the power source voltage Vdc from a preliminarily set reference supply voltage Vdc0 (for example, 12V), and calculates an output signal SV1*c* after correction by adding a value which multiplied the voltage division ratio RR1 of the primary voltage detection unit 15 to the fluctuation amount DVdc of the power source voltage, to the output signal SV1 of the primary voltage detection unit 15.

$$\Delta Vdc = Vdc0 - Vdc$$

$$SV1c = SV1 + RR1 \times \Delta Vdc \tag{8}$$

<Temperature Change Correction of Winding Resistor of Secondary Coil>

Since the winding resistor of the secondary coil L2 has a large temperature characteristic, a resistance value of the winding resistor is varied largely when temperature of the coil is varied. For example, when the temperature of the coil rises by 100° C., the winding resistor becomes about 1.4 times. Therefore, the resistance value R2*e* of the discharge path of the secondary current is varied according to the temperature of the coil, and the variation DV1 of the primary voltage by the secondary current is varied as shown in the equation (1). Then, as seen from the equation (6) and the equation (7), in order to reduce a signal component generated by the secondary current I2 from the output signal SV1 of the primary voltage detection unit 15, it is necessary to correct the output voltage SI2 of the secondary current detection resistance 20 according to the variation of the resistance value R2*e* of the discharge path of the secondary current.

Then, the primary voltage correction unit 17 estimates a temperature of the secondary coil, based on the driving condition of the internal combustion engine. For example, the primary voltage correction unit 17 calculates the temperature of the secondary coil corresponding to the present driving condition, by referring to a coil temperature map in which the relationship between the driving condition, such as the rotational speed and the charging efficiency, and the temperature of the secondary coil is preliminarily set. Alternatively, the primary voltage correction unit 17 detects the temperature of the secondary coil based on an output signal of a temperature sensor provided in the ignition coil 14.

Then, the primary voltage correction unit 17 performs correction which reduces variation of the signal component generated by the secondary current due to variation of the winding resistor of the secondary coil, based on the temperature of the secondary coil. In the present embodiment, the primary voltage correction unit 17 calculates a temperature correction coefficient Ktc corresponding to the present temperature of the secondary coil, by referring to a correction coefficient setting map in which the relationship between the temperature of the secondary coil and the temperature correction coefficient Ktc is preliminarily set; and calculates an output voltage SI2*c* after correction by multiplying the temperature correction coefficient Ktc to the output voltage SI2 of the secondary current detection resistance 20, as shown in a next equation. Herein, the temperature correction coefficient Ktc becomes a ratio of the resistance value R2*e* of the discharge path of the secondary current at the present temperature of the secondary coil with respect to a resistance value R2*e*0 of the discharge path of the secondary current at a reference coil temperature.

$$SI2c = Ktc \times SI2 \tag{9}$$

$$Ktc = \frac{R2e}{R2e0}$$

<Variation correction of coupling coefficient of ignition coil 14>

In the second equation of the equation (1), it was explained that the coupling coefficient of the primary coil L1 and the secondary coil L2 is 1. However, the coupling coefficient may be varied from 1, and the output voltage SV1 of the primary voltage detection unit 15 is varied according to variation of the coupling coefficient.

Then, the primary voltage correction unit 17 estimates a coupling coefficient K between the primary coil and the secondary coil at each time in the spark discharge period, and corrects the output signal SV1 of the primary voltage detection unit based on the coupling coefficient K. In the present embodiment, the primary voltage correction unit 17 calculates the coupling coefficient K corresponding to the present detection value of the secondary current, by referring to a coupling coefficient map in which the relationship between the secondary current and the coupling coefficient is preliminarily set. For example, the primary voltage correction unit 17 calculates an output signal SV1*c* after correction by dividing the output signal SV1 of the primary voltage detection unit by the coupling coefficient K, as shown in a next equation. One or both of correction of the equation (8) and correction of the equation (10) may be performed at the same time.

$$SV1c = \frac{SV1}{K} \tag{10}$$

Then, as shown in a next equation, the primary voltage correction unit 17 calculates a primary voltage signal ADJSV1 after correction by subtracting the output voltage SI2*c* after correction from the output signal SV1*c* after correction.

$$ADJSV1 = SV1c - SI2c \tag{11}$$

OTHER EMBODIMENTS

Lastly, other embodiments of the present disclosure will be explained. Each of the configurations of embodiments to be explained below is not limited to be separately utilized but can be utilized in combination with the configurations of other embodiments as long as no discrepancy occurs.

(1) In each of the above-mentioned Embodiments, there has been explained the case where the secondary current detection unit 16 is the secondary current detection resistance 20 connected in series on the discharge path, and outputs the voltage SI2 of the high-voltage side terminal of the secondary current detection resistance 20. However, the secondary current detection unit 16 may estimate the secondary current at each time in the present ignition cycle, based on the generating period of the primary voltage in the past ignition cycle. The secondary current detection unit 16 is included in the controller 24. The generating period of the primary voltage can be determined from a period when the output signal SV1 of the primary voltage detection unit (or the primary voltage signal ADJSV1 after correction) is higher than a value corresponding to the power source voltage. The generating period of the primary voltage is corresponding to the spark discharge period. The secondary current increases stepwise during the spark discharge period, and after that, decreases gradually to zero at almost constant inclination. Then, the secondary current detection unit 16 calculates a statistical processing value (for example, an average processing value) of the generating period of the primary voltage in the past ignition cycle; calculates an initial value and an inclination of the secondary current, based on the statistic value of the generating period of the primary voltage; increases the secondary current stepwise to the calculated initial value at the time when turning off the driver circuit 11 in this time ignition cycle; and after that, decreases the secondary current gradually to 0 at the calculated inclination. The primary voltage correction unit 17 calculates the variation ΔV1 of the primary voltage by the secondary current based on the secondary current using the third equation of the equation (1), and corrects the detection value of the primary voltage.

Alternatively, the secondary current detection unit 16 may calculate the characteristic data of the secondary current corresponding to the present driving condition of the internal combustion engine, by referring to a secondary current map in which the relationship between the driving condition of the internal combustion engine and the characteristic data of the secondary current is preliminarily set; and estimate the secondary current at each time in the ignition cycle based on the characteristic data of the secondary current. The driving condition of the internal combustion engine is set to the rotational speed, the charging efficiency, and the like. The characteristic data of the secondary current is set to the initial value, the inclination, and the like. The secondary current detection unit 16 increases the secondary current stepwise to the calculated initial value at the time point of turning off the driver circuit 11, and after that, decreases the secondary current gradually to 0 at the calculated inclination. The primary voltage correction unit 17 calculates the variation ΔV1 of the primary voltage by the secondary current based on the secondary current using the third equation of the equation (1), and corrects the detection value of the primary voltage.

Alternatively, various kinds of circuits which can detect current may be used for the secondary current detection unit 16. For example, the secondary current detection unit 16 may be a current transformer or a Hall sensor arranged on the discharge path of the secondary current, and output a signal of the current transformer or the Hall sensor.

(2) In each of the above-mentioned Embodiments, there has been explained the case where the primary voltage detection unit 15 is the resistive potential divider connected in parallel with the driver circuit 11, and outputs the divided voltage SV1 of the primary voltage V1. However, various kinds of circuits which can detect voltage may be used for the primary voltage detection unit 15. For example, a voltage follower circuit using operational amplifier may be used.

(3) In the above-mentioned Embodiments 1 to 3, there has been explained the case where the primary voltage correction unit 17 is configured by the differential amplifying circuit. However, the primary voltage correction unit 17 may be configured by circuit, such as an operational amplifier or IC.

(4) In the above-mentioned Embodiments 1 to 3, there has been explained the case where the discharge state determination unit 23 is configured by the comparator circuit. However, as Embodiment 4, the discharge state determination unit 23 may be configured by an arithmetic processor, such as CPU, to perform more complex processing. For example, the discharge state determination unit 23 may change the primary voltage threshold value V1ref according to the driving condition of the internal combustion engine; and may calculate a differential value of the primary voltage signal ADJSV1 after correction, and estimate the spark discharge state based on the differential value.

(5) In each of the above-mentioned Embodiments, there has been explained the case where the resistance value R20 of the secondary current detection resistance is set as the second equation of the equation (6). However, the resistance value R20 of the secondary current detection resistance may be set to a value other than this. In this case, in the primary voltage correction unit 17, there is provided an amplifier circuit or a multiplication processing of gain, which adjusts both scales, to one or both of the output signal SI2 of the secondary current detection unit 16 and the output signal SV1 of the primary voltage detection unit 15.

(6) In the above-mentioned Embodiment 4, there has been explained the case where the primary voltage correction unit 17 and the discharge state determination unit 23 are included in the controller 24. However, the primary voltage correction unit 17 and the discharge state determination unit 23 may be built in a switching IC which configures the driver circuit 11, and the Switching IC may have a calculation function.

(7) The high-voltage side voltage dividing resistance 18 of the primary voltage detection unit 15 may be arranged in a resin molding in which the ignition coil 14 and the driver circuit 11 are arranged, and the low-voltage side voltage dividing resistance 19 may be arranged out of the resin molding.

Although the present disclosure is described above in terms of various exemplary embodiments and implementations, it should be understood that the various features, aspects and functionality described in one or more of the individual embodiments are not limited in their applicability to the particular embodiment with which they are described, but instead can be applied, alone or in various combinations to one or more of the embodiments. It is therefore understood that numerous modifications which have not been exemplified can be devised without departing from the scope of the present disclosure. For example, at least one of the constituent components may be modified, added, or eliminated. At least one of the constituent components mentioned in at least one of the preferred embodiments may be selected and combined with the constituent components mentioned in another preferred embodiment.

What is claimed is:

1. A discharge state detecting apparatus of an internal combustion engine comprising:

an ignition plug that has a first electrode and a second electrode which oppose via a gap, and ignites a combustible gas mixture in a combustion chamber;

an ignition coil that has a primary coil in which power is supplied from a DC power source, and a secondary coil which is magnetically coupled with the primary coil and supplies power to the ignition plug;

a driver circuit that turns on or turns off an energization to the primary coil from the DC power source;

a primary voltage detector that detects a primary voltage generated on the primary coil side during spark discharge of the ignition plug;

a secondary current detector that detects a secondary current which flows into the secondary coil during the spark discharge of the ignition plug;

a primary voltage corrector that performs correction which reduces a signal component generated by the secondary current in the ignition coil, from the primary voltage detected by the primary voltage detector, based on the secondary current detected by the secondary current detector, and outputs a primary voltage after correction; and a discharge state determiner that determines a spark discharge state based on the primary voltage after correction.

2. The discharge state detecting apparatus of the internal combustion engine according to claim 1, wherein the primary voltage corrector performs correction which reduces a variation of the primary voltage due to a variation of a power source voltage, based on source voltage information of the DC power source.

3. The discharge state detecting apparatus of the internal combustion engine according to claim 1, wherein the secondary current detector is a resistance connected in series on a discharge path of the secondary current, and outputs a terminal voltage of the resistance.

4. The discharge state detecting apparatus of the internal combustion engine according to claim 3, wherein a resistance value of the resistance is less than or equal to 1000.

5. The discharge state detecting apparatus of the internal combustion engine according to claim 1, wherein the secondary current detector estimates the secondary current at each time in a present ignition cycle, based on a generating period of the primary voltage in a past ignition cycle.

6. The discharge state detecting apparatus of the internal combustion engine according to claim 1, wherein the secondary current detector, by referring to a secondary current map in which a relationship between a driving condition of the internal combustion engine and a characteristic data of the secondary current is preliminarily set, calculates the characteristic data of the secondary current corresponding to the present driving condition of the internal combustion engine, and estimates the secondary current at each time in the present ignition cycle based on the characteristic data of the secondary current.

7. The discharge state detecting apparatus of the internal combustion engine according to claim 1, wherein the secondary current detector is a current transformer or a Hall sensor arranged on a discharge path of the secondary current, and outputs a signal of the current transformer or the Hall sensor.

8. The discharge state detecting apparatus of the internal combustion engine according to claim 1, wherein the primary voltage corrector estimates a temperature of the secondary coil based on a driving condition of the internal combustion engine, and performs correction which reduces variation of the signal component generated by the secondary current due to variation of a winding resistor of the secondary coil, based on the temperature of the secondary coil.

9. The discharge state detecting apparatus of the internal combustion engine according to claim 1, wherein the primary voltage corrector detects a temperature of the secondary coil with a temperature sensor, and performs correction which reduces variation of the signal component generated by the secondary current due to variation of a winding resistor of the secondary coil, based on the temperature of the secondary coil.

10. The discharge state detecting apparatus of the internal combustion engine according to claim 1, wherein the primary voltage corrector estimates a coupling coefficient between the primary coil and the secondary coil at each time in the spark discharge period, and corrects an output signal of the primary voltage detector based on the coupling coefficient.

11. The discharge state detecting apparatus of the internal combustion engine according to claim 1, wherein the primary voltage corrector is a differential amplifying circuit, and outputs an amplification value of a difference between an output signal of the primary voltage detector and an output signal of the secondary current detector.

12. The discharge state detecting apparatus of the internal combustion engine according to claim 11, wherein the secondary current detector is a resistance connected in series on a discharge path of the secondary current, and outputs a terminal voltage of the resistance, wherein the primary voltage detector is a resistive potential divider connected in parallel with the driver circuit, and outputs a divided voltage of the primary voltage, and wherein a resistance value of the resistance of the secondary current detector is set to a value obtained by dividing a total value of a voltage division ratio of the primary voltage detector and a resistance value of the discharge path of the secondary current, by a winding number ratio of the ignition coil.

13. The discharge state detecting apparatus of the internal combustion engine according to claim 1, wherein the primary voltage detector is a resistive potential divider connected in parallel with the driver circuit, and outputs a divided voltage of the primary voltage.

14. The discharge state detecting apparatus of the internal combustion engine according to claim 13, wherein the resistive potential divider has a high voltage side voltage dividing resistance connected to a terminal side of the primary coil and a low voltage side voltage dividing resistance connected to a ground side, and the high voltage side voltage dividing resistance and the low voltage side voltage dividing resistance are connected in series, wherein the high voltage side voltage dividing resistance is arranged within a resin molding in which the ignition coil and the driver circuit are arranged, and wherein the low voltage side voltage dividing resistance is arranged out of the resin molding.

15. The discharge state detecting apparatus of the internal combustion engine according to claim 1, wherein the discharge state determiner determines that a discharge extension between the electrodes of the ignition plug is large, when the primary voltage signal after correction is larger than a threshold value; and determines that the discharge extension between the electrodes of the ignition plug is small, when the primary voltage signal after correction is smaller than the threshold value.

16. The discharge state detecting apparatus of the internal combustion engine according to claim 1, further comprising:

a controller that controls a combustion state, based on the determination result of the spark discharge state by the discharge state determiner.

17. The discharge state detecting apparatus of the internal combustion engine according to claim 1, further comprising:

a controller that increases an ignition frequency in one ignition cycle, based on determination result of the spark discharge state by the discharge state determiner.

18. The discharge state detecting apparatus of the internal combustion engine according to claim 1, further comprising:

a controller that determines discharge abnormality of the ignition plug, based on determination result of the spark discharge state by the discharge state determiner.

* * * * *